US005478368A

United States Patent [19]

Lewtas et al.

[11] Patent Number: 5,478,368

[45] Date of Patent: Dec. 26, 1995

[54] ADDITIVES FOR DISTILLATE FUELS AND DISTILLATE FUELS CONTAINING THEM

[75] Inventors: Kenneth Lewtas, Wantage; Jacqueline D. Bland, Totton, both of United Kingdom

[73] Assignee: Exxon Chemical Patents Inc., Linden, N.J.

[21] Appl. No.: 937,907

[22] PCT Filed: Apr. 19, 1991

[86] PCT No.: PCT/GB91/00622

§ 371 Date: Oct. 13, 1992

§ 102(e) Date: Oct. 13, 1992

[87] PCT Pub. No.: WO91/16407

PCT Pub. Date: Oct. 31, 1991

[30] Foreign Application Priority Data

| | | | |
|---|---|---|---|
| Apr. 19, 1990 | [GB] | United Kingdom | 9008813 |
| Nov. 23, 1990 | [GB] | United Kingdom | 9025499 |

[51] Int. Cl.[6] ..... C10L 1/18; C10L 1/20

[52] U.S. Cl. ..... 44/394; 44/390; 44/395

[58] Field of Search ..... 44/393, 390, 394, 44/395; 252/56 R

[56] References Cited

U.S. PATENT DOCUMENTS

| | | | |
|---|---|---|---|
| 2,542,542 | 2/1951 | Lippincott et al. | 252/56 |
| 3,048,479 | 8/1962 | Ilnyckyj et al. | 44/62 |
| 3,252,771 | 5/1966 | Clough et al. | 44/62 |
| 3,280,027 | 10/1966 | Pierre | 252/56 R |
| 3,390,083 | 6/1968 | Lion | 252/56 R |
| 3,444,082 | 5/1969 | Kautsky | 252/51.5 |
| 3,762,888 | 10/1973 | Kober et al. | 44/393 |
| 3,961,916 | 6/1976 | Ilnyckyj et al. | 44/62 |
| 4,004,255 | 8/1977 | Von Zalin | 252/56 R |
| 4,108,612 | 8/1978 | Rossi et al. | 44/393 |
| 4,153,422 | 5/1979 | Wisotsky | 44/62 |
| 4,153,423 | 5/1979 | Wisotsky | 44/393 |
| 4,153,424 | 5/1979 | Wisotsky | 44/62 |
| 4,211,534 | 7/1980 | Feldman | 44/62 |
| 4,332,689 | 6/1982 | Ramzakie et al. | 252/56 R |
| 4,375,973 | 3/1983 | Rossi et al. | 44/62 |
| 4,402,708 | 9/1983 | Oswald | 44/66 |
| 4,517,105 | 5/1985 | Laemmle et al. | 252/56 R |
| 4,634,550 | 1/1987 | Feldman et al. | 252/56 R |

FOREIGN PATENT DOCUMENTS

| | | |
|---|---|---|
| 0085803 | 8/1983 | European Pat. Off. . |
| 0155807 | 9/1985 | European Pat. Off. . |
| 0061895 | 3/1986 | European Pat. Off. . |
| 0225688 | 6/1987 | European Pat. Off. . |
| 0261957 | 3/1988 | European Pat. Off. . |
| 0282342 | 9/1988 | European Pat. Off. . |
| 0308176 | 3/1989 | European Pat. Off. . |
| 0306290 | 3/1989 | European Pat. Off. . |
| 0153177 | 11/1991 | European Pat. Off. . |
| 0153176 | 11/1991 | European Pat. Off. . |
| 1914559 | 10/1969 | Germany . |
| 55-40640 | 10/1980 | Japan . |
| 0040640 | 10/1980 | Japan . |
| 56-54038 | 12/1981 | Japan . |
| 56-54037 | 12/1981 | Japan . |
| 0054038 | 12/1981 | Japan . |
| 0054037 | 12/1981 | Japan . |
| 0010198 | 3/1988 | Japan . |
| 0683465 | 11/1952 | United Kingdom . |
| 0706742 | 4/1954 | United Kingdom . |
| 0760994 | 11/1956 | United Kingdom . |
| 0866498 | 4/1961 | United Kingdom . |
| 0903701 | 8/1962 | United Kingdom . |
| 0961395 | 6/1964 | United Kingdom . |
| 1124437 | 8/1968 | United Kingdom . |
| 1209676 | 10/1970 | United Kingdom . |
| 1244506 | 9/1971 | United Kingdom . |
| 1263152 | 9/1972 | United Kingdom . |
| 1437132 | 5/1976 | United Kingdom . |
| 1469016 | 3/1977 | United Kingdom . |
| 1468588 | 3/1977 | United Kingdom . |
| 1542295 | 3/1979 | United Kingdom . |
| 2023645 | 10/1982 | United Kingdom . |
| 2129012 | 5/1984 | United Kingdom . |

OTHER PUBLICATIONS

JP56050995 Abstract.

Journal of the Institute of Petroleum "New Laboratory Test for Predicting Low-temperature Operability of Diesel Fuels" T. Coley, L. F. Rutishauser, and H. M. Ashton Jun. 1966, vol. 52, Issue 510, pp. 173–185.

*Primary Examiner*—Margaret Medley

*Attorney, Agent, or Firm*—John J. Mahon

[57] ABSTRACT

Polymer of number average molecular weight 1,000 to 20,000 containing the repeating units (I) (II) or (III) (II) have been found useful as low temperature flow improvers for distillate fuels particularly in combination with other additives.

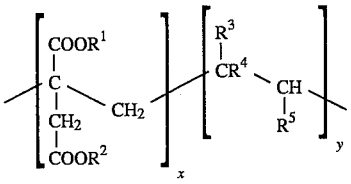

(I) (II)

or

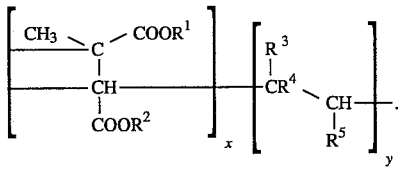

(III) (II)

6 Claims, No Drawings

ADDITIVES FOR DISTILLATE FUELS AND DISTILLATE FUELS CONTAINING THEM

This invention relates to novel polymers useful as flow improvers for fuel oils and to oil and fuel oil compositions to which a flow improver has been added.

When oils and fuel oils are subjected to low ambient temperatures wax will separate out and impair the flow properties unless a Cold Flow Improver is added. The nature of the wax depends upon the type of fuel and this invention is particularly concerned with additives to treat Distillate Fuels which precipitate normal alkane waxes which in the absence of additives form large plates which will block fuel lines and filters.

The invention relates to wax containing Distillate Fuels treated with additives whose size and structural configuration are particularly suited to the crystallography of the wax crystals which form in the Distillate Fuel as it cools, so that the additives interact with these waxes during crystallisation to produce precipitated wax of reduced crystal size.

Mineral oils containing paraffin wax have the characteristic of becoming less fluid as the temperature of the oil decreases. This loss of fluidity is due to the crystallisation of the wax into plate-like crystals which eventually form a spongy mass entrapping the oil therein. The temperature at which the wax crystals begin to form is known as the Cloud Point and the temperature at which the wax prevents the oil from pouring as the Pour Point. Between these temperatures the wax crystals can however block filters and pipes rendering systems such as diesel trucks and domestic heating systems inoperable. The effectiveness of additives to improve the operability at low temperatures can be evaluated by tests such as the CFPP and PCT and their ability to depress the Cloud Point and Wax Appearance Point can also be ascertained.

It has long been known that various additives act as wax crystal modifiers when blended with waxy mineral oils. These compositions modify the size and shape of wax crystals and reduce the cohesive forces between the crystals and between the wax and the oil in such a manner as to permit the oil to remain fluid at lower temperature and in some instances to have improved filterability at temperatures between the cloud point and the pour point.

Various Pour Point depressants have been described in the literature and several of these are in commercial use. For example, U.S. Pat. No. 3,048,479 teaches the use of copolymers of ethylene and $C_1$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g. propylene, are also known.

U.S. Pat. No. 3,961,916 teaches the use of a mixture of copolymers, to control the size of the wax crystals and United Kingdom Patent 1,263,152 suggests that the size of the wax crystals may be controlled by using a copolymer having a low degree of side chain branching. Both systems improve the ability of the fuel to pass through filters as determined by the Cold Filter Plugging Point (CFPP) test since instead of plate like crystals formed without the presence of additives the needle shaped wax crystals produced will not block the pores of the filter rather forming a porous cake on the filter allowing passage of the remaining fluid.

Other additives have also been proposed for example, United Kingdom Patent 1,469,016, suggests that the copolymers of di-n-alkyl fumarates and vinyl acetate which have previously been used as pour depressants for lubricating oils may be used as co-additives with ethylene/vinyl acetate copolymers in the treatment of Distillate Fuels with high final boiling points to improve their low temperature flow properties.

U.S. Pat. No. 3,252,771 relates to the use of polymers of $C_{16}$ to $C_{18}$ alpha-olefins obtained by polymerising olefin mixtures that predominate in normal $C_{16}$ to $C_{18}$ alpha-olefins with aluminium trichloride/alkyl halide catalysts as pour depressants in Distillate Fuels of the broad boiling types available in the United States in the early 1960's.

It has also been proposed to use additives based on olefin/maleic anhydride copolymers. For example, U.S. Pat. No. 2,542,542 uses copolymers of olefins such as octadecene with maleic anhydride esterified with an alcohol such as lauryl alcohol as pour depressants and United Kingdom Patent 1,468,588 uses copolymers of $C_{22}$–$C_{28}$ olefins with maleic anhydride esterified with behenyl alcohol as co-additives for Distillate Fuels.

Similarly, Japanese Patent Publication 5,654,037 uses olefin/maleic anhydride copolymers which have been reacted with amines as pour point depressants and in Japanese Patent Publication 5,654,038 the derivatives of the olefin/maleic anhydride copolymers are used together with conventional middle distillate flow improvers such as ethylene vinyl acetate copolymers.

Japanese Patent Publication 5,540,640 discloses the use of olefin/maleic anhydride copolymers (not esterified) and states that the olefins used should contain more than 20 carbon atoms to obtain CFPP activity.

United Kingdom Patent 2,129,012 uses mixtures of esterified olefin/maleic anhydride copolymers and low molecular weight polyethylene, the esterified copolymers being ineffective when used as sole additives. The patent specifies that the olefin should contain 10–30 carbon atoms and the alcohol 6–2 carbon atoms with the longest chain in the alcohol containing 22–40 carbon atoms.

U.S. Pat. Nos. 3,444,082; 4,211,534; 4,375,973 and 4,402,708 suggest the use of certain nitrogen containing compounds.

Long n-alkyl derivatives of difunctional compounds have also been described as has their use as wax crystal modifiers for Distillate Fuels, to wit derivatives, particularly amine derivatives of alkenyl succinic acid (U.S. Pat. No. 3,444,082), maleic acid (U.S. Pat. No. 4,211,534) and phthalic acid (GB 2923645, U.S. Pat. No. 4,375,973 and U.S. Pat. No. 4,402,708). Amine salts of certain alkylated aromatic sulphonic acids are described in United Kingdom Patent Specification 1209676 as is their use as antitrust additives for turbine oils and hydraulic oils.

The improvement in CFPP activity achieved by the incorporation of the additives of these Patents is achieved by modifying the size and shape of the wax crystals forming to produce needle like crystals generally of particle size 10,000 nanometers or bigger typically 30,000 to 100,000 nanometers. In operation of diesel engines or heating systems at low temperatures, these crystals do not generally pass through the filters but form a permeable cake on the filter which may allow the liquid fuel to pass, the wax crystals will subsequently dissolve as the engine and the fuel heats up, which can be by the bulk fuel being heated recycled fuel. The wax crystals can however block the filters, leading to starting problems and problems at the start of driving in cold weather or failure of fuel heating systems.

In European Patent Publication 0225688 we describe the use of itaconate and citraconate polymers and copolymers as flow improvers which are effective in improving the cold flow properties of an oil (crude or lubricating) and fuel oils such as residual fuel middle Distillate Fuels and jet fuel or as a dewaxing aid in lubricating oil and which can be tailored to suit the particular oil or fuel oil concerned. These polymers and copolymers were described as having number average molecular weights as measured by Gel Permeation Chromatography of from 1,000 to 500,000 and the specific materials exemplified had molecular weights of 20,000 and higher.

Specifically European Patent Publication 0225688 provides a crude oil, lubricating oil or fuel oil containing a minor proportion by weight of a polymer containing the units:

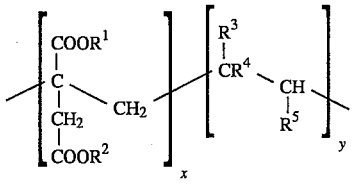

(I) (II)

or

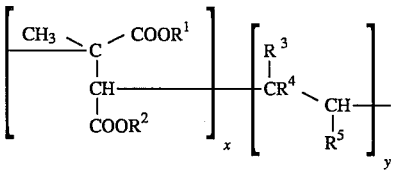

(III) (II)

where x is an integer and y is 0 or an integer and wherein in the total polymer x+y is at least two and the ratio of units (II) to units (I) is between 0 and 2, the ratio of units (II) to (III) is between 0 and 2 and wherein:

$R^1$ and $R^2$, the same or different, are $C_{10}$ to $C_{30}$ alkyl, $R^3$ is H, —OOC $R^6$, $C_1$ to $C_{30}$ alkyl, —COO $R^6$ —$OR^6$, an aryl or alkaryl group or halogen, $R^4$ is H or methyl, $R^5$ is H, $C_1$ to $C_{30}$ alkyl, or —$COOR^6$.

$R^6$ is $C_1$ to $C_{22}$ alkyl each of the groups $R^1$, $R^2$, $R^3$, $R^4$, $R^5$ and $R^6$ can be inertly substituted if desired.

We have now found that the use of polymers and copolymers of this general formula of number average molecular weight in the range 1,000 to 20,000 as additives for Distillate Fuels results in the formation of particularly small wax crystals in the fuel, smaller than those achieved when using the higher molecular weight analogues. We have also found that this effect is particularly marked when the low molecular weight polymers and copolymers are used in combination with other types of additive.

The present invention therefore provides the use as a flow improver in Distillate Fuel oil of a polymer of number average molecular weight 1,000 to 20,000 containing the repeating units:

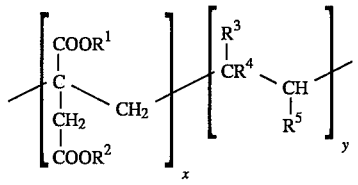

(I) (II)

or

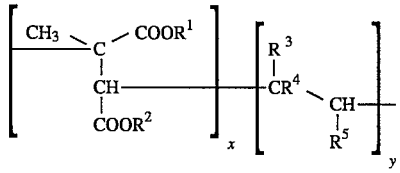

(III) (II)

where x is an integer and y is 0 or an integer and wherein in the total polymer x+y is at least two and the ratio of units (II) to units (I) is between 0 and 2, the ratio of units (II) to (III) is between 0 and 2, and wherein:

$R^1$ and $R^2$, the same or different are $C_{10}$ to $C_{30}$ alkyl, $R^3$ is H, —OOC $R^6$, $C_1$ to $C_{30}$ alkyl, —COO $R^6$, an aryl or aralkyl group or halogen, $R^4$ is H or methyl, $R^5$ is H, $C_1$ to $C_{30}$ alkyl or —$COOR^6$, $R^6$ is $C_1$ to $C_{22}$ alkyl and provided each of the groups $R^1$, $R^2$, $R^3$, $R^4$, $R^5$ and $R^6$ can be inertly substituted.

The invention further provides Distillate Fuel containing the polymer as defined above and an additive concentrate comprising a solution of a polymer as defined above suitable for incorporation into Distillate Fuels.

The preferred polymers are homopolymers of a dialkyl itaconate or citraconate or copolymers of a dialkyl itaconate or citraconate with an aliphatic olefin, a vinyl ether, a vinyl ester of an alkanoic acid, an alkyl ester of an unsaturated acid, an aromatic olefin, a vinyl halide or a dialkyl fumarate or maleate.

The groups $R^1$ and $R^2$ which can be the same or different are $C_{10}$ to $C_{30}$ alkyl groups, and these are preferably straight chain although they can be branched. If branched it is preferred that the branch be a single methyl in the 1 or 2 position. Examples of the groups $R^1$ and $R^2$ are decyl, dodecyl, hexadecyl and eicosyl. Each of the groups $R^1$ and $R^2$ may be a single $C_{10}$ to $C_{30}$ alkyl group or they may be mixtures of alkyl groups. It has been found that mixtures of $C_{12}$ to $C_{20}$ alkyl groups are particularly suitable when the polymer is to be used as a flow improver in middle Distillate Fuel oils. Likewise, suitable chain lengths are $C_{16}$ to $C_{22}$ for use of the polymers in heavy fuel oils and crude oils and $C_{10}$ to $C_{18}$ for use of the polymer in lubricating oils. These preferred chain lengths are applicable both for homopolymers and copolymers.

At least two polymers as defined in the present invention may be used in combination to advantage in a particular embodiment of the invention. Thus, as will be illustrated in the examples hereinafter, a first polymer may be selected to inhibit the tendency of wax to settle from a distillate fuel at reduced temperature, and a second polymer, being different from the first polymer, may be selected to counter any tendency of the first polymer to regress the CFPP performance of the fuel. For example, the first and second such polymers may be homopolymers of a dialkylitaconate where the alkyl groups of the first polymer are the same as one another and the alkyl groups of the second polymer are the same as one another, those of the first polymer each having at least two (preferably two) carbon atoms fewer than those of the second polymer. Examples of such first polymers are those where the alkyl groups (i.e. $R^1$ and $R^2$ in the general formula herein) are $C_{14}$ or $C_{16}$ or $C_{18}$. In specific examples, the alkyl groups of the first polymer are $C_{16}$ when those of the second polymer are $C_{18}$, and the alkyl groups of the first polymer are $C_{18}$ when those of the second polymer are $C_{20}$.

In the above-described particular embodiment, the ratio of the first polymer to the second polymer may, for example, be in the range of 10:1 to 1:10. Where one or more other flow improver is used (such as described hereinafter), the ratio of such flow improvers to the first and second polymers together may, for example, be in the range of 10:1 to 1:10.

As an example, the ratio of the first polymer to the second polymer is 1:1, their combined ratio to any other flow improver also being 1:1. All of the above ratios are weight-:weight (ai).

When copolymers of dialkyl itaconates or dialkyl citraconates are used y, being integer, the above-mentioned comonomer is a compound of the formula:

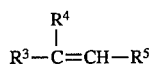

where $R^3$, $R^4$ and $R^5$ are as defined above. Such comonomer can be one or more of a variety of compounds and in all cases mixtures of compounds having the above formula can be used.

When the comonomer is an aliphatic olefin $R^3$ and $R^5$ are hydrogen or identical or non-identical $C_1$ to $C_{30}$ alkyl groups, preferably n-alkyl groups. Thus, when $R^3$, $R^4$ and $R^5$ are all hydrogen, the olefin is ethylene, and when $R^3$ is methyl, $R^4$ and $R^5$ are hydrogen, the olefin is n-propylene. When $R^3$ is an alkyl group it is preferred that $R^4$ and $R^5$ are hydrogen. Examples of other suitable olefins are butene-1, butene-2, isobutylene, pentene-1, hexene-1, tetradecene-1, hexadecene-1 and octadecene-1 and mixtures thereof.

Other suitable comonomers are vinyl esters or alkyl substituted vinyl esters of $C_2$ to $C_{31}$ alkanoic acids, i.e. for vinyl esters when $R^3$ is $R^6$ COO—, $R^4$ is H and $R^5$ is H, and for alkyl substituted vinyl esters when $R^5$ is $R^6$ COO— and $R^4$ is methyl and/or $R^5$ is $C_1$ to $C_{30}$ alkyl. Non-substituted vinyl esters are preferred and suitable examples are vinyl acetate, vinyl propionate, vinyl butyrate, vinyl decanoate, vinyl hexadecanoate and vinyl stearate.

Another class of comonomers are the alkyl esters of unsaturated acids, i.e. when $R^3$ is a $R^6$OOC— and $R^5$ is H or $C_1$ to $C_{30}$ alkyl. When $R^4$ and $R^5$ are hydrogen these comonomers are alkyl esters of acrylic acid. When $R^4$ is methyl the comonomers are esters of methacrylic acid or $C_1$ to $C_{30}$ alkyl substituted methacrylic acid. Suitable examples of alkyl esters of acrylic acid are methyl acrylate, n-hexyl acrylate, n-decyl acrylate, n-hexadecyl acrylate, n-octadecyl acrylate, and 2-methyl hexadecyl acrylate, whilst suitable examples of alkyl esters of methacrylic acid are propyl methacrylate, n-butyl methacrylate, n-octyl methacrylate, nØtetradecyl methacrylate, n-hexadecyl methacrylate and nØoctadecyl methacrylate. Other examples are the corresponding esters where $R^5$ is alkyl, e.g. methyl, ethyl, n-hexyl, n-decyl, n-tetradecyl and n-hexadecyl.

Another suitable class of comonomers is when both $R^3$ and $R^5$ are $R^6$OOC—, i.e. when they are $C_1$ to $C_{22}$ dialkyl fumarates or maleates and the alkyl groups may be n-alkyl or branched alkyl, e g n-octyl n-decyl, n-tetradecyl, n-hexadecyl or n-octadecyl.

Other examples of comonomer are when $R^3$ is an aryl group. When $R^4$ and $R^5$ are hydrogen and $R^3$ is phenyl the comonomer is styrene and when one of $R^4$ and $R^5$ is methyl and comonomer is a methyl styrene, e.g. -methyl styrene. Another example when $R^3$ is aryl is vinyl naphthalene. Other suitable examples when $R^3$ is alkaryl are for example substituted styrenes such as vinyl toluene, or 4-methyl styrene.

Another suitable co-monomer is when $R^3$ is halogen, e.g. chlorine, such as vinyl chloride ($R^4$ and $R^5$ hydrogen).

In all cases it is to be understood that some or all of the groups $R^1$, $R^2$, $R^3$, $R^4$, $R^5$ and $R^6$ can be inertly substituted, for example, by one or more halogen atoms, for instance, chlorine or fluorine. Thus, for example, the comonomer could be vinyl trichloroacetate. Alternatively, the substituent could be an alkyl group, e.g. methyl.

The ratio of units (II) to units (I) should be between 0 (when the polymer is an itaconate or citraconate homopolymer) and 2 (when the polymer is a copolymer) but in practice the ratio for the copolymer will usually be between 0.5 and 1.5. Usually the copolymer will consist of only units (I) and (II) or units (II) and (III), but other units are not excluded. However, in practice, it is desirable that the weight percentage of units (I) and (II) or of units (II) and (III) in the copolymer is at least 60% and preferably at least 70%.

For both homopolymers and copolymers the molecular weight of the polymer will be between 1,000 and 20,000, preferably between 1,000 and 10,000, more preferably between 2,200 and 5,000. We have found that particular small wax crystals are obtained in Distillate Fuels when polymers or copolymers of molecular weights in this range are used. Molecular weights are measured by gel permeation chromatography (GPC) relative to polystyrene standards.

The homopolymers and copolymers are generally prepared by polymerising the monomers neat or in solution in a hydrocarbon solvent such as heptane, benzene, cyclohexane, or white oil, at a temperature generally in the range of from 20° C. to 150° C. and usually promoted with a peroxide or azo type catalyst such as benzoyl peroxide or azodiisobutyronitrile under a blanket of an inert gas such as nitrogen or carbon dioxide in order to exclude oxygen. The polymer may be prepared under pressure in an autoclave or by refluxing.

When copolymers are to be prepared the polymerisation reaction mixture should preferably contain up to 2 moles of comonomer (e.g. vinyl acetate) per mole of dialkyl itaconate or dialkyl citraconate.

The copolymers are suitable for use as low temperature flow improvers in fuel oils. These fuel oils can be the Middle Distillate Fuel oils, e.g. a diesel fuel, aviation fuel, kerosene, fuel oil, jet fuel, heating oil, etc. Generally, suitable Distillate Fuels are those boiling in the range of 120° to 500° C. (ASTM D-86), preferably those boiling in the range 150° to 400° C., for example, those having a relatively high final boiling point (FBP) of above 360° C. A representative heating oil specification calls for a 10 percent distillation point no higher than about 226° C., a 50 percent point no higher than about 272° C. and a 90 percent point of at least 282° C. and no higher than about 338° C. to 343° C., although some specifications set the 90 percent as high as 357° C. Heating oils are preferably made of a blend of virgin distillate, e.g. gas oil, naphtha, etc. and cracked distillates, e.g. catalytic cycle stock. A representative specification for a diesel fuel includes a minimum flash point of 38° C. and a 90 percent distillation point between 282° C. and 338° C. (See ASTM Designations D-396 and D-975).

The best effect is usually obtained when the polymer additives of the invention are used in combination with other additives known for improving the cold flow properties of Distillate Fuels generally. The polymer additives of the invention may however be used on their own.

The additives of the invention are particularly effective when used in combination with comb polymers of the general formula.

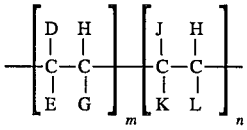

where

D=R, C(O).OR, OC(O).R, $R^1$C(O).OR or OR

E=H or $CH_3$ or D or $R^1$

G=H, or D m=1.0 (homopolymer) to 0.4 (mole ratio)

J=H, $R^1$, Aryl or Heterocyclic group, $R^1$CO.OR

K=H, C(O) .$OR^1$, OC(O) .$R^1$, $OR^1$, C(O)OH

L=H, $R^1$, C(O) .$OR^1$, OC(O) .$R^1$, Aryl, C(O)OH n=0.0 to 0.6 (mole ratio)

R is a hydrocarbyl group containing more than 10 carbon atoms, preferably from 10 to 30 carbon atoms $R^1$ is a $C_1$ to $C_{30}$ hydrocarbyl group.

The comb polymers may contain termonomers.

Examples of suitable comb polymers are the fumarate/vinyl acetate particularly those described in our European Patent Publications 0153176, 0153177, and esterified olefine/maleic anhydride copolymers and the polymers and copolymers of alpha olefines and esterified copolymers of styrene and maleic anhydride.

Examples of other additives which may be included in the compositions of this invention are the polyoxyalkylene esters, ethers, ester/ethers amide/esters and mixtures thereof, particularly those containing at least one, preferably at least two $C_{10}$ to $C_{30}$ linear saturated alkyl groups of a polyoxyalkylene glycol group of molecular weight 100 to 5,000 preferably 200 to 5,000, the alkyl group in said polyoxyalkylene glycol containing from 1 to 4 carbon atoms. European Patent Publication 0,061,895 A2 describes some of these additives.

The preferred esters, ethers or ester/ethers may be structurally depicted by the formula:

$$R—O—(A)—O—R^1$$

where R and $R^1$ are the same or different and may be i) n-alkyl ii) n-alkyl-C(=O)— iii) n-alkyl-O—C(=O)—$(CH_2)_n$— iv) n-alkyl-O—C(=O)—$(CH_2)_n$—C(=O)— alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$-$C_{24}$ fatty acid, especially behenic acids. The esters may also be prepared by esterifying polyethoxylated fatty acids or polyethoxylated alcohols. A may also contain nitrogen in which case the materials may be obtained by esterification of ethoxylated amines.

Other suitable additives for inclusion in the fuel compositions of this invention are ethylene unsaturated ester copolymer flow improvers. The unsaturated monomers which may be copolymerised with ethylene include unsaturated mono and diesters of the general formula:

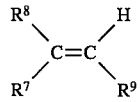

wherein $R^8$ is hydrogen or methyl, $R^7$ is a —$OOCR^{10}$ group wherein $R^{10}$ is hydrogen or $C_{28}$, a $C_1$ to $C^8$, straight or branched chain alkyl group; or $R^7$ is a —$COOR^{10}$ group wherein $R^{10}$ is as previously defined but is not hydrogen and $R^9$ is hydrogen or —$COOR^{10}$ as previously defined. The monomer, when $R^7$ and $R^9$ are hydrogen and $R^8$ is —$OOCR^{10}$ includes vinyl alcohol esters of $C_1$ to $C_{29}$, more usually $C_1$ to $C_{18}$, monocarboxylic acid, and preferably $C_2$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. It is preferred that the copolymers contain from 10 to 40 wtØ% of the vinyl ester, more preferably from 25 to 35 wtØ% vinyl ester. They may also be mixtures of two copolymers such as those described in U.S. Pat. No. 3,961,916. It is preferred that these copolymers have a number average molecular weight as measured by vapour phase osmometry of 1,000 to 6,000, preferably 1,000 to 4,000.

Other suitable additives for inclusion in the fuel compositions of the present invention are polar compounds, either ionic or non-ionic, which have the capability in fuels of acting as wax crystal growth inhibitors. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$-$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amines, cocoamine, hydrogenated tallow amine and the like. Examples of secondary amines include dioctacedyl amine, methyl-behenyl amine and the like. Amine mixtures are also suitable and many amines derived from natural materials are mixtures. The preferred amine is a secondary hydrogenated tallow amine of the formula $NHR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids or their anhydrides for preparing these nitrogen compounds (and their anhydrides) include cyclohexane, 1,2 dicarboxylic acid, cyclohexane dicarboxylic acid, cyclopentane 1,2 dicarboxylic acid naphthalene dicarboxylic acid and the like. Generally, these acids will have about 5–13 carbon atoms in the cyclic moiety. Preferred acids are benzene dicarboxylic acids such as phthalic acid, tera-phthalic acid, and iso-phthalic acid. Phthalic acid or its anhydride is particularly preferred. Alkyl substituted succinic acid or anhydride may also be used. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt.

Examples of other suitable co-additives include the compounds described in our European Patent Application 0261957 which are compounds of the general formula:

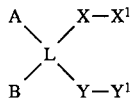

where

A and B may be the same or different and may be alkyl, alkenyl or aryl;

L is selected from the group consisting of

>CH—CH< and

>C=C< and A, B and L together can constitute part of a cyclic structure, which can be aromatic, alicyclic or mixed aromatic/alicylic and with the proviso that when A,B and L do not constitute part of a cyclic structure one of A or B may be hydrogen and in that when L is non-cyclic ethylenic, said $X—X^1$ and $Y—Y^1$ groupings are present in a cis configuration;

X is selected from the group consisting of $SO_3^{(-)}$, —C(O)—, —C(O)O$^{(-)}$, —$R^4$—C(O)—, —$NR^3$C(O)—— $R^4$O—, —$R^4$OC(O)—, —$R^4$— and —NC(O)—;

$X^1$ is selected from the group consisting of $N^{(+)}R_3{}^3R^2$, $HN^{(+)}R^3R_2{}^2$, $H_2N^{(+)}R^3R^2$, $H_3N^{(+)}R^2$, $N^{(+)}R_3{}^3R^1$, $N^{(+)}HR_2{}^3R^1$, $H_2N^{(+)}R^3R^1$, $H_3N^{(+)}R^1$, $NR^3R^2$, —$R^2$, —$NR^3R^1$, and $R^1$;

Y is —$SO_3^-$ or —$SO_2$—;

When Y is $SO_3^{(-)}$, $Y^1$ is selected from the group consisting of $N^{(+)}R_3{}^3R^2$, $HN^{(+)}R_2{}^3R^2$, $H_2N^{(+)}R^3R^2$, $H_3N^{(+)}R^2$, and when Y is —$SO_2$—$y^1$ is —$OR^2$, —$NR^3R^2$ or —$R^2$and wherein $R^1$ and $R^2$ are independently selected from the group consisting of alkyl typically $C_{10}$ to $C_{40}$ alkyl more preferably $C_{10}$ to $C_{30}$ more preferably $C_{14}$ to $C_{24}$ alkyl, alkoxy alkyl or polyalkoxyalkyl groups containing at least 10 typically ten to 40 carbon atoms in their main chain $R^3$ is hydrocarbyl preferably alkyl, more preferably $C_1$ to $C_{30}$ most preferably $C_{10}$ to $C_{30}$ straight chain alkyl and each $R^3$ may be the same or different and $R^4$ is —$(CH_2)_n$ where n is from 0 to 5.

It is preferred that $X^1$ and $Y^1$ together contain at least three alkyl, alkoxy alkyl or polyalkoxy alkyl groups.

In these compounds A and B together or separately form one or more bulky groups, L is the linking group which may also be part of the bulky group, X and/or Y are configurational groups and $X^1$ and/or $Y^1$ constitute the adsorbing groups.

When L is part of a cyclic structure together with A and B, the cyclic structure may be aromatic, alicyclic, or mixed aromatic/alicyclic. More specifically the cyclic structure may be mono-cyclic or polycyclic aromatic, polynuclear aromatic, heteroaromatic, and heteroalicyclic. The ring structure may be saturated or unsaturated with one or more unsaturations; with at least one ring containing 4 or more atoms, and it may be multicyclic, bridged and may be substituted. When the cyclic structure is heterocyclic it may include one or more of N, S or O atoms.

Examples of suitable monocyclic ring structures are benzene, cyclohexane, cyclohexene, cyclopentane, pyridine and furan. The ring structure may contain additional substituents.

Suitable polycyclic compounds, that is those having two or more ring structures, can take various forms. They can be (a) fused aromatic structures, (b) fused partially hydrogenated aromatic ring structures where at least one but not all rings are aromatic, (c) alicyclic which includes fused alicyclic, bridged alicyclic, spiro alicyclic compounds (d) hydrocarbon ring assemblies of like or unlike rings which may be aromatic, alicyclic or mixed; (e) any of (a) to (d) which contain at least one hereto atom.

Fused aromatic structures from which the compounds defined by L, A and B collectively may be derived include for example naphthalene, anthracene, phenathrene, fluorene, pyrene and indene. Suitable condensed ring structures where none or not all rings are benzene include for example azulene, hydronaphthalene, hydroindene, hydrofluorene, diphenylene. Suitable bridged alicyclic structures include bicycloheptane and bicycloheptene.

Suitable ring assemblies include biphenyl and cyclohexyl benzene.

Suitable heteropolycyclic structures include quinuclidine and indole.

Suitable heterocyclic compounds defined by L, A and B collectively from which the compounds of this invention may be derived include quinoline; indole, 2,3 dihydroindole, benzofuran, coumarin and isocoumarin, benzothiophene, carbazole and thiodiphenylamine.

Suitable non-aromatic or partially saturated ring systems defined by L, A and B collectively include decalin (decahydronaphthalene), ØØ-pinene, cadinene, bornylene. Suitable bridged compounds include norbornene, bicycloheptane (norbornane), bicyclo octane and bicyclo octene.

When L, A and B form part of a cyclic structure X and Y are preferably attached to adjoining ring atoms located completely within a single ring whether mono- or polycyclic. For example if one were to use naphthalene, these substituents could not be attached to the 1,8- or 4,5-positions, but would have to be attached to the 1,2-, 2,3-, 3,4-, 5,6-, 6,7- or 7,8- positions.

The hydrogen- and carbon-containing groups in the substituents A and B when L is ethylenic and not part of a ring with A and B, are preferably alkyl, typically $C_1$ to $C_{24}$ alkyl or alkenyl, aryl typically $C_6$ to $C_{14}$ aryl. Such groups may also be halogenated preferably only containing a small proportion of halogen atoms (e.g. chlorine atoms), for example less than 20 weight per cent. The A and B groups are preferably aliphatic, e.g. alkylene. They are preferably straight chain. Unsaturated hydrocarbyl groups, e.g. alkenyl, could be used but they are not preferred.

When the compounds are used as Distillate Fuel additives we prefer that $R^1$, $R^2$, and $R^3$ when present contain 10 to 24 carbon atoms, for example 14 to 22 preferably 18 to 22 carbon atoms and are preferably straight chain or branched at the 1 or 2 position. Suitable alkyl groups include decyl, dodecyl, tetradecyl, eicosyl and docosyl (behenyl). Alternatively the groups may be polyethylene oxide or polypropylene oxide, the main chain of the groups being the longest linear segment.

The especially preferred compounds are the amides or amine salts of secondary amines. Although two substituents are necessary for the cyclic derivatives described above it should be realised that these cyclic compounds can contain one or more further substituents attached to ring atoms of the cyclic compounds.

These compounds may be prepared from a reactant such as

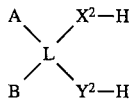

where A, B, L are as previously defined and $X^2$ and $Y^2$ are as defined in connection with X and Y and additionally $X^2$ and $Y^2$ together can form part of a cyclic anhydride structure wherein an oxy group (O) is common to both $X^2$ and $Y^2$.

Preferred reactants are those in which $X^2$ is selected from —C(O)O— and —$SO_3$(–) and particularly preferred reactants are compounds of the formula:

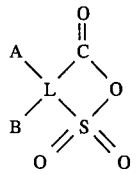

The most preferred reactants are compounds in which A, B and L together are part of a cyclic structure especially an aromatic ring. A particularly preferred reactant is represented by the formula:

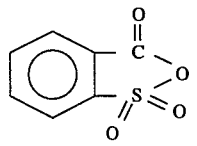

in which the aromatic ring may be substituted, and in which the aromatic ring represents A,B and L collectively, and $X^2$ and $Y^2$ together form an anhydride ring.

The compounds are prepared by reacting both the $Y^2$—H group and the $X^2$—H group with amines, alcohols, quaternary ammonium salts etc. or mixtures thereof. Where the final compounds are the amides or amine salts they are preferably of a secondary amine which has a hydrogen and carbon containing group containing at least 10 carbon atoms preferably a straight chain alkyl group containing from 10 to 30 more preferably 16 to 24 carbon atoms. Such amides or salts may be prepared by reacting the acid or anhydride with a secondary amine or alternatively by reaction with an amine derivative. Removal of water and heating are generally necessary to prepare the amides from the acids. Alternatively the $Y^2$—H and $X^2$—H groups may be reacted with an alcohol containing at least 10 carbon atoms or a mixture of an alcohol and an amine or sequentially with an amine and an alcohol or vice-versa.

Thus, the final additive compounds, comprise as a result of the identity of X—$X^1$, and Y—$Y^1$ esters, amides, ethers, primary, secondary or tertiary amine salts, amino amides, amino ethers and the like.

The preferred compounds of this type are of the formulae:

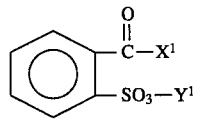

more preferably

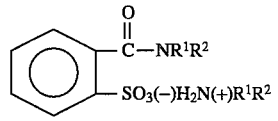

and

-continued

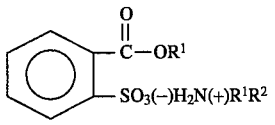

Hydrocarbon polymers may also be used in additive combinations of the present invention, these may be of the following general formula:

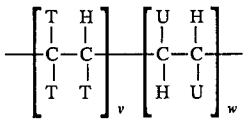

where each may be

T=H or $R^1$

U=H, T or Aryl v=1.0 to 0.0 (mole ratio)

w=0.0 to 1.0 (mole ratio)

where $R^1$ is alkyl.

These polymers may be made directly from ethylenically unsaturated monomers or indirectly by hydrogenating the polymer made from monomers such as isoprene, butadiene, etc.

A particularly preferred hydrocarbon polymer is a copolymer of ethylene and propylene having an ethylene content preferably between 20 and 60% (w/w) and is commonly made via homogeneous catalysis.

One or more of these co-additives may be used in the compositions of this invention.

When mixtures of additives are used the relative proportions of additives used in the mixtures are preferably from 0.05 20 parts by weight more preferably from 0.1 to 5 parts weight of the itaconate or citraconate polymer or copolymer to 1 part of the other additives.

The total amount of additive added to the fuel oil is preferably 0.0001 to 5.0 wtØ%, for example, 0.001 to 0.5 wtØ% (active matter) based on the weight of fuel oil.

The additives may conveniently be dissolved in a suitable solvent to form a concentrate of from 20 to 90, e.g. 30 to 80 weight % of the polymer in the solvent. Suitable solvents include kerosene, aromatic naphthas, mineral lubricating oils, etc. Such concentrates are also within the scope of this invention.

The present invention is illustrated by the following Examples in which the following additives were used.

Additive A

The N,N-dialkyl ammonium salt of 2-dialkylamido benzene sulphonate where the alkyl groups are $nC_{16-18}$ $H_{33-37}$. Prepared by reacting 1 mole of ortho-sulphobenzoic acid cyclic anhydride with 2 moles of di-(hydrogenated) tallow amine in a xylene solvent at 50% (w/w) concentration. The reaction mixture was stirred at between 100° C. and the refluxing temperature. The solvent and chemicals should be kept as dry as possible so as not to enable hydrolysis of the anhydride.

The product was analysed by 500 MHz Nuclear Magnetic Resonance Spectroscopy and the spectrum confirmed the structure to be

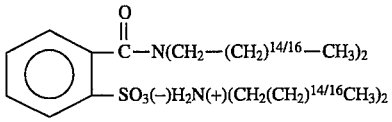

Additive B

An ethylene vinyl acetate copolymer of number average molecular weight 3500 containing 13.5 wt % vinyl acetate and containing 8 methyls per 100 methylene groups.

Additive C

Various itaconate polymers prepared by polymerising the monomers in cyclohexane solvent using a free radical catalyst.

Oligomeric materials of number average molecular weight 4000 and polymeric materials of molecular weight 80,000 were prepared for the sake of comparison. Each contained $C_{12}$ to $C_{18}$ linear alkyl groups in the itaconate esters. These are referred to in the table that follows as $C_{10}$ PI, $C_{12}$ PI, $C_{14}$ PI, etc.

Additive D

The reaction product of one mole of phthalic anhydride with two moles of dihydrogenated tallow amine, to form a half amide/half amine salt.

Additive E

An ethylene vinyl acetate copolymer of number average molecular weight 3000 containing 29% vinyl acetate and containing 4 methyl groups per 100 methylene groups.

Additive F

Additive D blended with 10 wt % benzoic acid as a stabilizer.

Additive G

The 3 nitro derivative of Additive D

The various additives were used in combination at a treat rate of 250 ppm each in a Distillate Fuel having the following characteristics Cloud Point −2° C.

Untreated CFPP −4° C.

ASTM D-86 distillation °C.

Initial Boiling Point 178

| | | | |
|---|---|---|---|
| 5% | 227 | 50% | 291 |
| 10% | 243 | 60% | 301 |
| 20% | 261 | 70% | 311 |
| 30% | 272 | 80% | 324 |
| 40% | 282 | 90% | 341 |

Final Boiling Point 368 and tested in the following tests.

Testing

The effectiveness of additive systems as filterability improvers in Distillate Fuels were determined by the following methods.

By one method, the response of the oil to the additives was measured by the Cold Filter Plugging Point Test (CFPP) which is carried out by the procedure described in detail in "Journal of the Institute of Petroleum", Volume 52, Number 510, June 1966, pp. 173–285. This test is designed to correlate with the cold flow of a middle distillate in automotive diesels.

In brief, a 40 ml. sample of the oil to be tested is cooled in a bath which is maintained at about −34° C. to give non-linear cooling at about 1° C./min. Periodically (at each one degree C. starting from above the cloud point), the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml. of oil. After each successful passage, the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression (dCFPP) by the additive. A more effective flow improver gives a greater CFPP depression at the same concentration of additive.

Another determination of flow improver effectiveness is made under conditions of the flow improver Programmed Cooling Test (PCT) which is a slow cooling test designed to indicate whether the wax in the fuel will pass through filters such as are found in heating oil distribution system.

In the nest, the cold flow properties of the described fuels containing the additives were determined as follows. 300 ml. of fuel are cooled linearly at 1° C./hour to the test temperature and the temperature then held constant. After 2 hours at −12° C., approximately 20 ml. of the surface layer is moved as the abnormally large wax crystals which tend to form on the oil/air interface during cooling. Wax which has settled in the bottle is dispersed by stirring, then a CFPP filter assembly is inserted. The tap is opened to apply a vacuum of 500 mm. of mercury and closed when 200 ml. of fuel have passed through the filter into the graduated receiver. A PASS is recorded if the 200 ml. are collected within 60 seconds through a given mesh size of a FAIL if the flow rate is too slow indicating that the filter has become blocked.

CFPP filter assemblies with filter screens of 20, 30, 40, 60, 80, 100, 120, 150, 200, 250, 350, VW LTFT and 500 mesh number and then 25, 20, 15 and 10 microns are used to determine the finest filter the fuel will pass. The larger the mesh number that a wax containing fuel will pass, the smaller are the wax crystals and the greater the effectiveness of the additive flow improver. It should be noted that it is unlikely that two fuels will give exactly the same test results at the same treatment level for the same flow improver additive. In the tables herein, the relative order is also given, higher numbers representing a finer filter passed.

Wax settling studies were also performed prior to PCT filtration. The extent of the settled layer (WAS) was visually measured as a % of the total fuel volume by leaving the treated fuel in a measuring flask. This extensive wax settling would be given by a low number whilst an unsettled fluid fuel would be at a state of 100%. Care must be taken because poor samples of gelled fuel with large wax crystals almost always exhibit high values, therefore these results should be recorded as "gel".

The effectiveness of the additives of the present invention in lowering the Cloud Point of Distillate Fuels can be determined by the standard Cloud Point Test (IP-219 or ASTM-D 2500) other measures of the onset of crystallisation are the Wax Appearance Point (WAP) Test (ASTM D.3117–72) and the Wax Appearance Temperature (WAT) as measured by differential scanning calorimetry using a Mettler TA 2000B differential scanning calorimeter. In the test a 25 microliter sample of the fuel is cooled at 2° C./min. from a temperature at least 30° C. above the expected cloud point of the fuel. The observed onset of crystallisation is estimated, without correction for thermal lag (approximately 2° C.), as the wax appearance temperature as indicated by the differential scanning calorimeter. This is the preferred method because of its accuracy and repeatability and is consequently the method of choice here.

The Wax Appearance Temperature (WAT) of the fuel is measured by differential scanning calorimetry (DSC). In this test a small sample of fuel (25 ul) is cooled at 2° C./minute together with a reference sample of similar thermal capacity but which will not precipitate wax in the temperature range of interest (such as kerosene). An exotherm is observed when crystallisation commences in the sample. For example the WAT of the fuel may be measured by the extrapolation technique on the Mettler TA 2000B. dWAT is the depression of the Wax Appearance Temperature from the base fuel due to the incorporation of the additive in the fuel.

The wax content is derived from the DSC trace by integrating the area enclosed by the baseline and the exotherm down to the specified temperature. The calibration having been previously performed on a known amount of crystallizing wax.

The wax crystal average particle size is measured by analysing an Optical Micrograph of a fuel sample and measuring the longest axis of crystals.

The crystal shape is determined by taking magnified photographs of the wax crystals in the fuel.

The Results of the tests are set out in Table 1 as follows:

TABLE 1

| Additive | | | | Polyitaconate Composition % Polymer | % Oligomer | % WAS | Size (nanometres) | Crystal Shape | PCT | Relative PCT | CFPP | dCFPP | dWAT |
|---|---|---|---|---|---|---|---|---|---|---|---|---|---|
| A | B | | | | | 100 | | Plates | 120 | 7 | −16 | 12 | 0.5 |
| A | B | C10 | PI | 100 | 0 | 100 | 30–80 | Plates | 120 | 7 | −17 | 13 | 1.2 |
| A | B | C10 | PI | 20 | 80 | 100 | 0–50 | Plates | 150 | 8 | −18 | 14 | 0.6 |
| A | B | C12 | PI | 100 | 0 | 100 | 10–20 | Bypyramid | VW | 12 | −19 | 15 | 0.6 |
| A | B | C12 | PI | 20 | 80 | 100 | 5–20 | Bypyramid | 25 μm | 15 | −19 | 15 | 0.6 |
| A | B | C12 | PI | 0 | 100 | 100 | 10–50 | Plates | 120 | 7 | −17 | 13 | 0.8 |
| A | B | C12 | PI | 0 | 100 | 100 | 10–80 | Plates | 120 | 7 | −20 | 16 | 0.8 |
| A | B | C14 | PI | 100 | 0 | Grad floc | >200 | Ribbons & dendrites | 60 | 4 | −8 | 4 | 1.8 |
| A | B | C14 | PI | 45 | 55 | 70 | >200 | Dendrites | 60 | 4 | −10 | 6 | 1.5 |

TABLE 1-continued

| | | | | | | | | | | | | | |
|---|---|---|---|---|---|---|---|---|---|---|---|---|---|
| A | B | C14 | PI | 30 | 70 | 50 | >200 | Dendrites | 60 | 4 | −11 | 5 | 1.4 |
| A | B | C14 | PI | 0 | 100 | 100 | 10–30 | Nodules | 100 | 6 | −18 | 14 | 1.7 |
| A | B | C16 | PI | 100 | 0 | 100 | 10–50 | Plates | 150 | 8 | −14 | 10 | 1.0 |
| A | B | C16 | PI | 25 | 75 | 100 | 10–20 | Small | 200 | 9 | −14 | 10 | 1.6 |
| A | B | C16 | PI | 10 | 90 | 100 | ~10 | Small | 15 μm | 17 | −14 | 10 | 1.9 |
| A | B | C16 | PT | 0 | 100 | 100 | <10 | Small | 20 μm | 16 | −15 | 11 | 2.1 |
| A | B | C18 | PI | 0 | 100 | 100 | 10–>200 | Plates | 40 | 3 | −17 | 13 | 0.5 |
| A | B | C18 | PI | 0 | 100 | 100 | 10–>200 | Plates | 40 | 3 | −15 | 11 | 0.6 |

| Additive | | | | % Polymer | % Oligomer | % WAS | Crystal Size (nanometres) | Crystal Shape | PCT | Relative PCT | CFPP | dCFPP | dWAT |
|---|---|---|---|---|---|---|---|---|---|---|---|---|---|
| G | B | | | | | 100 | 10–30 | Small | 120 | 7 | −12 | 9 | 0.9 |
| G | B | C10 | PI | 100 | 0 | 100 | 10–20 | Small | 120 | 7 | −14 | 11 | 0.8 |
| G | B | C10 | PI | 20 | 80 | 100 | 10–20 | Small | 120 | 7 | −13 | 10 | 0.8 |
| G | B | C12 | PI | 100 | 0 | 100 | 10–20 | Needles | 500 | 14 | −19 | 16 | 1.0 |
| G | B | C12 | PI | 20 | 80 | 100 | <=10 | Small | 500 | 14 | −15 | 12 | 0.7 |
| G | B | C12 | PI | 0 | 100 | 100 | <=10 | Small | VW | 12 | −13 | 10 | 0.8 |
| G | B | C12 | PI | 0 | 100 | 100 | <=20 | Small | 25 μm | 15 | −14 | 11 | 0.9 |
| G | B | C14 | PI | 100 | 0 | Grad floc | >300 | Strings | 60 | 4 | −6 | 3 | 1.6 |
| G | B | C14 | PI | 45 | 55 | Grad floc | >300 | Strings | 40 | 3 | −7 | 4 | 1.4 |
| G | B | C14 | PI | 30 | 70 | Grad floc | >300 | Strings | 40 | 3 | −7 | 4 | 1.4 |
| G | B | C14 | PI | 0 | 100 | 30 | >200 | Large, Undefined | 40 | 3 | −8 | 5 | 1.5 |
| G | B | C16 | PI | 100 | 0 | 50 | 10–70 | Small & plates | 60 | 4 | −12 | 9 | 1.0 |
| G | B | C16 | PI | 25 | 75 | 80 | <10–250 | Small & plates | 80 | 5 | −9 | 6 | 1.6 |
| G | B | C16 | PI | 10 | 90 | 100 | <10 | Small | 15 μm | 17 | −7 | 4 | 1.9 |
| G | B | C16 | PI | 0 | 100 | 100 | <10 | Small | 25 μm | 15 | −6 | 3 | 2.0 |
| G | B | C18 | PI | 0 | 100 | Heavy floc | 30–750 | Needles & plates | 60 | 4 | −10 | 7 | 0.6 |
| G | B | C18 | PI | 0 | 100 | Heavy floc | 30–550 | Needles & plates | 60 | 4 | −11 | 8 | 0.7 |

| Additve | | | | % Polymer | % Oligomer | % WAS | PCT | Relative PCT | CFPP | dCFPP | dWAT |
|---|---|---|---|---|---|---|---|---|---|---|---|
| E | | | | | | 60 | 60 | 4 | −16 | 12 | |
| | F | | | | | 20 | 40 | 3 | −10 | 6 | |
| E | F | | | | | 80 | 120 | 7 | −14 | 10 | |
| E | A | | | | | 80 | 500 | 14 | −19 | 15 | 0.8 |
| E | G | | | | | 95 | 100 | 6 | −16 | 12 | 0.8 |
| B | F | | | | | 25 | 60 | 4 | −17 | 13 | 0.1 |
| B | A | | | | | 100 | 120 | 3 | −16 | 12 | 0.5 |
| B | G | | | | | 100 | 120 | 7 | −12 | 9 | 0.9 |
| E | F | C16 | PI | 0 | 100 | 100 | 15 μm | 17 | −10 | 6 | 1.9 |
| E | F | C16 | PI | 10 | 90 | 100 | 15 μm | 17 | −14 | 10 | |
| E | F | C16 | PI | 100 | 0 | Floc | VW | 12 | −18 | 14 | 0.8 |
| B | F | C16 | PI | 0 | 100 | 100 | 25 μm | 15 | −8 | 4 | 1.9 |
| B | F | C16 | PI | 10 | 90 | 100 | 500 | 14 | −8 | 4 | 1.7 |
| B | F | C16 | PI | 100 | 0 | 60 | 120 | 7 | −13 | 9 | 0.8 |
| E | A | C16 | PI | 0 | 100 | 100 | 15 μm | 17 | −14 | 10 | 2.2 |
| E | A | C16 | PI | 10 | 90 | 100 | 20 μm | 16 | −13 | 9 | 2.1 |
| E | A | C16 | PI | 100 | 0 | 100 | 500 | 14 | −18 | 14 | 1.2 |
| B | A | C16 | PI | 0 | 100 | 100 | 20 μm | 16 | −15 | 11 | 2.1 |
| B | A | C16 | PI | 10 | 90 | 100 | 15 μm | 17 | −14 | 10 | 1.9 |
| B | A | C16 | PI | 100 | 0 | 100 | 150 | 8 | −14 | 10 | 1.0 |
| E | G | C16 | PI | 0 | 100 | 100 | 20 μm | 16 | −7 | 3 | 2.1 |
| E | G | C16 | PI | 10 | 90 | 100 | 20 μm | 16 | −7 | 3 | 2.0 |
| E | G | C16 | PI | 100 | 0 | 80 | 80 | 5 | −15 | 11 | 1.1 |
| B | G | C16 | PI | 0 | 100 | 100 | 25 μm | 15 | −6 | 3 | 2.0 |
| B | G | C16 | PI | 10 | 90 | 100 | 15 μm | 17 | −7 | 4 | 1.9 |
| B | G | C16 | PI | 100 | 0 | 50 | 60 | 4 | −12 | 9 | 1.0 |

| Additve | | | | % Polymer | % Oligomer | % WAS | PCT | Relative PCT | CFPP | dCFPP |
|---|---|---|---|---|---|---|---|---|---|---|
| | | C10 | PI | 20 | 80 | Gel | 30 | 2 | −3 | −1 |
| | | C12 | PI | 20 | 80 | Gel | 30 | 2 | −3 | −1 |
| | | C14 | PI | 30 | 10 | Gel | 30 | 2 | −3 | −1 |
| | | C16 | PI | 10 | 90 | Floc | 20 | 1 | −4 | 0 |
| | | C18 | PI | 0 | 100 | Gpf | 40 | 3 | −8 | 4 |
| E | | C10 | PI | 20 | 80 | 60 | 60 | 4 | −13 | 9 |
| | | C12 | PI | 20 | 80 | 60 | 80 | 5 | −16 | 12 |
| | | C14 | PI | 30 | 70 | 75 | 60 | 4 | −9 | 5 |
| | | C16 | PI | 10 | 90 | Floc | 200 | 9 | −7 | 3 |
| | | C18 | PI | 0 | 100 | 80 | 80 | 5 | −12 | 8 |

TABLE 1-continued

| | | | | | | | | | |
|---|---|---|---|---|---|---|---|---|---|
| F | C10 | PI | 20 | 80 | 30 | 40 | 3 | −6 | 2 |
| | C12 | PI | 20 | 80 | 20 | 60 | 4 | −4 | 0 |
| | C14 | PI | 30 | 70 | 80 | 40 | 3 | −5 | 1 |
| | C16 | PI | 10 | 90 | 20 | 60 | 4 | −1 | −3 |
| | C18 | PI | 0 | 100 | 50 | 100 | 7 | −13 | 9 |
| F | C10 | PI | 20 | 80 | 75 | 120 | 7 | −17 | 13 |
| | C12 | PI | 20 | 80 | 85 | 150 | 8 | −19 | 15 |
| | C14 | PI | 30 | 70 | 80 | 100 | 6 | −17 | 13 |
| | C16 | PI | 10 | 90 | 100 | 15 μm | 17 | −14 | 10 |
| | C18 | PI | 0 | 100 | 100 | 120 | 7 | −19 | 15 |

In a further series of experiments the following additional additives were used.

Additive H

A mixture of two ethylene vinyl acetate copolymers: one of $M_n$ 2580 and containing 36.5 wt % vinyl acetate and the other of $M_n$ 5000 and containing 13.5 wt % vinyl acetate, the ratio of the two copolymers being 3:1 (weight:weight).

Additive I

As Additive H but where the ratio of two copolymers is 13:1 (weight: weight ).

Additive J

An ethylene vinyl acetate copolymer of number average molecular weight 2000 containing 28.0 wt % vinyl. The Additives were tested in the fuels having the properties set out in table 2:

TABLE 2

| Fuel No | 1 | 2 | 3 | 4 | 5 | 6 | 7 | 8 | 9 | 10 | 11 |
|---|---|---|---|---|---|---|---|---|---|---|---|
| Cloud °C. | −2 | −7 | 3 | −4 | −5 | −6 | −7 | +1 | −5 | −6 | −5 |
| ASTM D-86 | | | | | | | | | | | |
| ibp | 178 | 141 | 179 | 145 | 168 | 135 | 136 | 208 | 155 | 166 | 170 |
| 5% | 227 | 187 | 224 | | 215 | 182 | 177 | 232 | 195 | | |
| 10% | 243 | 197 | 238 | | 229 | 192 | 187 | 238 | 207 | 209 | 200 |
| 20% | 261 | 210 | 257 | 225 | 248 | 213 | 200 | 250 | 228 | 231 | 219 |
| 30% | 272 | 222 | 270 | | 261 | 239 | 214 | 260 | 247 | 250 | 238 |
| 40% | 282 | 235 | 282 | | 271 | 261 | 230 | 270 | 264 | 265 | |
| 50% | 291 | 249 | 293 | 260 | 279 | 277 | 248 | 281 | 277 | 276 | 270 |
| 60% | 301 | 264 | 305 | | 287 | 290 | 265 | 293 | 289 | 287 | |
| 70% | 311 | 282 | 318 | | 297 | 303 | 283 | 306 | 302 | 298 | 296 |
| 80% | 324 | 300 | 333 | | 309 | 315 | 304 | 321 | 316 | 310 | |
| 90% | 341 | 324 | 350 | 329 | 327 | 332 | 329 | 342 | 333 | 325 | 334 |
| 95% | 355 | 341 | 363 | 350 | 341 | 344 | 342 | 361 | 346 | | |
| fbp | 368 | 357 | 373 | 367 | 358 | 361 | 364 | 372 | 359 | 348 | 371 |
| Base CFPP | −4 | −9 | 0 | | −8 | −9 | −7 | −4 | −6 | −8 | −7 |

In the tests the treat rate is 250 ppm active ingredient of each additive. The wax antisettling was measured by:

(a) Visual examination of the vessel as described in the previous example. The figure gives the extent of wax settling and is further qualified by a letter, via C=clear above % layer, i.e. fuel has been dewaxed completely down to test temperature and all the wax has settled to bottom layer.

F=Floc, indicative of undesirable larger crystals present.

CL=Cloudy with bottom layer, a good anti-settling result.

In the results the letter H means Hazy, M means Milky and C is Clear, F is FLOC.

(b) Taking a top and bottom sample of 5 mls. They were then examined by measuring their WATS on a DSC as previously described. In an unsettled sample the two numbers would be the same. The bigger the difference between the numbers the greater the wax settling. Thus T–B range=WAT bottom–WAT top (°C.).

The results are set out in Table 3:

TABLE 3

| | | | WAS | PCT | Relative PCT | CFPP |
|---|---|---|---|---|---|---|
| Fuel 2 | | | (−18° C.) | | | |
| H | | | 30H | 100 | 6 | −19 |
| H | F | | 80CL | 500 | 14 | −23 |
| H | F | C10 FVA | 80C | 500 | 14 | −26 |
| H | F | C10–12FVA | 80C | 500 | 14 | −21 |
| H | F | C12 FVA | 25/75CL | 500 | 14 | −29 |
| H | F | C12–14 FVA | 25CL | VW | 13 | −20 |
| H | F | C14 FVA | 10H | 100 | 6 | −16 |
| H | F | C10 SFEC | 75H | LTFT | 13 | −20 |
| H | F | C10–12 SFEC | 80H | 500 | 14 | −23 |
| H | F | C12 SFEC | 90H | 25 μm | 15 | −22 |
| H | F | C12–14 SFEC | 25/75H | 500 | 14 | −23 |
| H | F | C14 SFEC | Grad hazy | VW | 12 | −19 |
| H | F | C16 PI (olig) | 100F | 10 μm | 18 | −19 |
| Fuel 3 | | | (−9° C.) | | | |
| H | | | 5/15C | 40 | 3 | −11 |
| H | F | | 50C | 60 | 4 | −14 |
| H | F | C12 FVA | 50C | 80 | 5 | −15 |
| H | F | C12–14 FVA | 80H | 100 | 6 | −17 |
| H | F | C14 FVA | 40H | 150 | 8 | −12 |
| H | F | C14–16 FVA | 100 gel | 60 | 4 | −3 |
| H | F | C16 FVA | 100 gel | 60 | 4 | −1 |
| H | F | C12 SFEC | 6011 | 60 | 4 | −17 |
| H | F | C12–14 SFEC | 50C | 80 | 5 | −15 |
| H | F | C14 SFEC | 60C | 100 | 6 | −15 |
| H | F | C14–16 SFFC | 30C | 60 | A | −11 |
| H | F | C16 SFEC | 100 gel | 60 | 4 | −2 |
| H | F | C16 PI (olig) | 30CL | 60 | 4 | −4 |
| H | F | C18 PI (olig) | 90CL | 150 | 8 | −16 |
| Fuel 4 | | | | | | |
| H | | | 10H | 100 | 6 | −22 |
| H | F | | 10H | LTFT | 13 | −26 |
| H | F | C12 FVAC | 5H | LTFT | 13 | −20 |
| H | F | C12–14 FVAC | H | 25 μm | 15 | −18 |
| H | F | C14 FVAC | H | VW | 12 | −18 |
| H | F | C14–16 FVAC | H | 100 | 6 | −16 |
| H | F | C12 SFEC | 10H | LTFT | 13 | −24 |
| H | F | C12–14 SFEC | 10H | LTFT | 13 | −22 |
| H | F | C14 SFEC | H | LTFT | 13 | −25 |
| H | F | C14–16 SFEC | H | VW | 12 | −17 |
| H | F | C16 PI (olig) | Milky | 10 μm | 18 | −11 |
| H | F | C18 PI (olig) | 20H | 20 μm | 16 | −24 |

| | | | Crystal Size | Crystal Shape | PCT | Relative PCT | CFPP | dWAT | T–B Range | WAS |
|---|---|---|---|---|---|---|---|---|---|---|
| Fuel 5 | | | | | | | | | | |
| I | | | 20 | Needles | 60 | 4 | −16 | −0.5 | 18.8 | 26C |
| I | F | | 20–50 | Needles | 250 | 10 | −18 | −0.4 | 8.3 | 47C |
| I | F | C16 PI (olig) | <<10 | Dots | 15 μm | 17 | −18 | 1.1 | 8.5 | 40CL |
| I | F | C12–14 FVAC | <10–40 | Modules | VW | 12 | −15 | 1.7 | 14.6 | <10CL |
| I | F | C16 FVAC | 20 | Fine needles | 200 | 9 | −15 | 0.7 | 11.2 | 48H |
| Fuel 6 | | | | | | | | | | |
| I | F | | 20–50 | Needles | <350 | <11 | −23 | −0.4 | 12 | 70F |
| I | F | C16PI (olig) | <10 | Dots | 20 μm | 16 | −17 | 1.2 | 0 | 100 |
| I | F | C12–14 FVAC | 30–50 | Thick needles | <350 | <11 | −19 | 0.6 | 16.5 | 26F |
| I | F | C16 FVAC | 10–50 | Needles | VW | 12 | −20 | 1.1 | 2 | 100F |
| Fuel 7 | | | | | | | | | | |
| I | F | | <10–20 | Needles | <350 | <11 | −29 | 0.3 | 22 | 24C |
| I | F | C16 PI (olig) | <<<10 | v. small | 154 μm | 17 | −15 | 3.1 | 3 | 96CL |
| I | F | C12–14 FVAC | <10 | Nodules | 500 | 14 | −19 | 1.2 | 12.5 | 35CL |
| I | F | C16 FVAC | 10–30 | Nodules & clumps | <350 | <11 | −13 | 3.1 | 19 | 31F |
| Fuel 8 | | | | | | | | | | |
| I | | | 10–60 | Mixture | 80 | 5 | −17 | −0.5 | 24.5 | 27C |
| I | F | | 10–50 | Needles | 200 | 9 | −19 | −0.3 | 20.3 | 40C |
| I | F | C16 PI (olig) | <<10 | Dots | VW | 12 | −9 | 2.3 | 11.6 | 10CL |
| I | F | C12–14 FVAC | 10–20 | Bypyramid & needles | VW | 12 | −17 | 0.1 | 2.9 | 5CL |
| I | F | C16 FVAC | | | 100 | 6 | −5 | 3.1 | 20.1 | 26C |

TABLE 3-continued

| | | | | | | | | | | |
|---|---|---|---|---|---|---|---|---|---|---|
| Fuel 9 | | | | | | | | | | |
| I | | | 50–100 | Nodules & plates | 60 | 4 | −11 | −1 | 22.5 | 20C |
| I | F | | 20–30 | Needles | 250 | 10 | −16 | 0.2 | 2 | 98CL |
| I | F | C16 PI (olig) | <10 | Dots | 25 μm | 15 | −11 | 1.6 | 5.7 | 100CL |
| I | F | C12–14 FVAC | 10–40 | Needles | 250 | 10 | −14 | 0.7 | 12.5 | 60H |
| I | F | C16 FVAC | 20–50 | Needles | 25 μm | 15 | −12 | 1.4 | 2.2 | 100CL |
| Fuel 10 | | | | | | | | | | |
| E | | | 100–200 | mixture | 40 | 3 | −12 | −0.9 | 16.5 | 17C |
| E | F | | 50–100 | needles | 60 | 4 | −19 | −0.6 | 20.1 | 30C |
| E | F | C12–14 FVAC | 70–170 | needles | 150 | 8 | −18 | −0.2 | 17 | 42C |
| E | F | C16 FVAC | 100–450 | — | 60 | 4 | −10 | 0.8 | 0 | 100M |
| E | F | C16 PI (olig) | 20–40 | needles | VW | 12 | −13 | 0.7 | 8.8 | 100M |
| E | F | C18 PI (olig) | 50–150 | needles | 120 | 9 | −17 | −0.6 | 11.7 | 65H |
| Fuel 11 | | | | | | | | | | |
| E | | | 10–150 | needles & plates | 80 | 4 | −19 | −2 | 21.1 | 45C |
| E | F | | 10–40 | nodules & needles | 250 | 10 | −20 | 2 | 15.7 | 30H |
| E | F | C12–14FVA | 10 | nodules & clumps | VW | 12 | −20 | −1.7 | 17.6 | 30H |
| E | F | C16FVA | 30–50 | needles | 120 | 7 | −12 | 2.7 | 15.5 | 30C |
| E | F | C16 PI (olig) | <=10 | v.small | 20 μm | 16 | −12 | 2 | 0.5 | 100M |
| E | F | C18 PI (olig) | <10 | — | 15 μm | 15 | −11 | −1.2 | 0.5 | 100M |
| Fuel 1 | | | | | | | | | | |
| B | | | 500 | Plates | 40 | 3 | −8 | | | Gel |
| E | | | 100–300 | Needles & plates | 80 | 5 | −16 | −4.6 | 25.4 | 43C |
| J | | | 100–200 | Needles & bipyramid | 80 | 5 | −15 | −2.1 | 23.4 | 25C |
| I | | | 70 | Needles & plates | 60 | 4 | −13 | 3.5 | 23.4 | 25C |
| B | F | | 20 | Needles | 80 | 5 | −18 | 0 | 23.4 | 40H |
| E | F | | 40 | Fine needles | 120 | 7 | −20 | −0.3 | 6.4 | 95H |
| J | F | | 20–40 | Fine needles | 100 | 6 | −19 | 0 | 17.7 | 77H |
| I | F | | 50 | Needles | 80 | 5 | −18 | −0.4 | 12.7 | 77C |
| B | F | C16 PI (olig) | <10 | Tiny needles | 15 μm | 17 | −8 | 1.3 | 2.3 | 100 |
| E | F | C16 PI (olig) | <10 | | 15 μm | 17 | −11 | 1.6 | 0.3 | 100 |
| J | F | C16 PI (olig) | <10 | | 15 μm | 17 | −4 | 2.1 | 5.6 | 100 |
| T | F | C16 PI (olig) | <10 | | 500 | 12 | −6 | 1.8 | 8.2 | 100 |
| B | F | C12–14 FVAC | 150 | Bypyramid | 100 | 6 | −16 | 0.2 | 20.5 | 38H |
| E | F | C12–14 FVAC | 30 | Needles | LTFT | 13 | −17 | 0.2 | 9.7 | 87CL |
| J | F | C12–14 FVAC | 50 | Needles | 250 | 10 | −17 | 0.3 | 15.5 | 49CL |
| I | F | C12–14 FVAC | 30–50 | Needs & bypyramid | 120 | 7 | −15 | 0.05 | 8.9 | 58H |

A still further set of experiments was carried out. The additives used were as follows, designated by the letters $A^1$, $B^1$, $D^1$, $E^1$ and $F^1$ to $M^1$, and the fuels used were those as characterised hereinafter:

$A^1$: For tests on Fuels I and II, A was a mixture of two ethylene/vinyl acetate copolymers: a copolymer of Mn 2580 containing 36.5 wt % vinyl acetate and containing 3–4 methyl groups per 100 methylene groups, and a copolymer of Mn 5000 containing 13.5 wt % vinyl acetate and containing 6 methyl groups per 100 methylene groups, the ratio of the two copolymers being 93:7 (weight:weight); for tests on the remaining fuels, A was an ethylene/vinyl acetate copolymer of Mn 3000 containing 29.0 wt % vinyl acetate and containing 4 methyl groups per 100 methylene groups.

$B^1$: the reaction product of one mole of phthalic anhydride with two moles of dihydrogenated tallow amine to form a half amide/half amine salt.

$D^1$: a homopolymer of an ester of itaconic acid whose linear alkyl groups have 16 carbon atoms made by polymerising the monomer using a free radical catalyst, the homopolymer having an Mw of 4000.

$E^1$: a blend of $D^1$ and a second polyitaconate made in the same way as additive $D^1$ but whose alkyl groups have 18 carbon atoms, the second polyitaconate also having an Mw of 4000.

$F^1$: the second polyitaconate as contained in Additive $E^1$.

It will be noted that certain of the additives correspond to those used in the experiments described hereinbefore in this specification. There is not necessarily any relationship between additives coded by the same letter whether with or without the superscript 1.

An additive (which includes a combination of individual additive components as identified by juxtaposition of the code letters in the results hereinafter) was added to a Diesel fuel at an additive concentration of 200 ppm (ai) for additive $A^1$, 200 ppm (ai) for additive $B^1$ and 200 ppm (ai) for additive $D^1$, $E^1$ or $F^1$, said additives being defined as above. The following tests were then carried out on the so-treated fuel: CFPP, WAS, and Determination of Crystal Size, each as described hereinbefore. The fuels used were fuels I to VIII whose characteristics are listed in Diagram 1 below, all temperatures being in °C.

DIAGRAM 1

| FUEL PROPERTIES | FUEL I | II | III | IV | V | VI | VII | VIII |
|---|---|---|---|---|---|---|---|---|
| Cloud Point | 6 | −5 | −6 | −7 | −4 | −4 | −2 | +3 |
| Base CFPP | −8 | −8 | −9 | −7 | −4 | | −4 | 0 |
| D–86 ibp | 166 | 168 | 135 | 136 | 200 | 145 | 178 | 179 |
| 20% | 231 | 248 | 213 | 200 | 252 | 225 | 261 | 257 |
| 50% | 276 | 279 | 277 | 248 | 284 | 260 | 291 | 293 |

-continued

| FUEL PROPERTIES | DIAGRAM 1 FUEL I | II | III | IV | V | VI | VII | VIII |
|---|---|---|---|---|---|---|---|---|
| 90% | 325 | 327 | 332 | 329 | 335 | 329 | 341 | 350 |
| Fbp | 348 | 358 | 361 | 364 | 364 | 367 | 368 | 373 |
| Test Temperature: | −17 | −15 | −19 | −17 | −15 | −15 | −15 | −9 |

Additives $A^1$, $B^1$ and D1-$F^1$, or combinations thereof, were, as stated above, tested in each of the fuels I–VIII. The results for CFPP, WAS and Crystal Size are shown in each of the following three tables, designated TABLES 4, 5, and 6 respectively where the following explanations are to be noted:

TABLE 4 (CFPP): all results are negative values

TABLE 5 (WAS): all results are percentage dispersed, 100 being fully dispersed and the observations being taken after 2 to 3 hours at the test temperature.

TABLE 6 (Crystal Size): all values are on a scale of 1 to 10 where

| | |
|---|---|
| 10 is <10 | microns |
| 9 is 10 | " |
| 8 is 10–20 | " |
| 7 is 20–50 | " |
| 6 is 50–100 | " |
| 5 is 100–200 | " |
| 4 is 200–300 | " |
| 3 is 300–500 | " |
| 2 is 500–700 | " |
| 1 is >700 | " |

The following general conclusions can be drawn from the results shown in TABLES 4–6:

Additives $A^1$ and $A^1B^1$ (comparison examples) gave good CFPP performance but less good WAS and Crystal Size performance.

Additives $A^1B^1D^1$ and $A^1B^1F^1$ gave good WAS and Crystal Size performance but regression in CFPP performance.

The above regression was cured by Additive $A^1B^1E^1$ at least in Fuels I to V (fbp<365° C.).

TABLE 4

| ADDITIVE | (CFPP) FUEL I | II | III | IV | V | VI | VII | VIII |
|---|---|---|---|---|---|---|---|---|
| $A^1$ | 11 | 14 | 14 | 25 | 8 | 19 | 13 | 10 |
| $A^1B^1$ | 13 | 19 | 20 | 14 | 14 | 24 | 18 | 13 |
| $A^1B^1D^1$ | 8 | 18 | 15 | 16 | 7 | 12 | 7 | 3 |
| $A^1B^1E^1$ | 16 | 18 | 21 | 15 | 14 | 12 | 17 | 8 |
| $A^1B^1F^1$ | 15 | 18 | 22 | 16 | 16 | 13 | 18 | 15 |

TABLE 5

| ADDITIVE | (WAS) FUEL I | II | III | IV | V | VI | VII | VIII |
|---|---|---|---|---|---|---|---|---|
| $A^1$ | 20 | 20 | 40 | 20 | 30 | 15 | 40 | 20 |
| $A^1B^1$ | 70 | 80 | 10 | 15 | 100 | 100 | 80 | 40 |
| $A^1B^1D^1$ | 100 | 100 | 80 | 100 | 100 | 100 | | 100 |
| $A^1B^1E^1$ | 95 | 95 | 100 | 100 | 100 | 100 | | 100 |
| $A^1B^1F^1$ | 95 | 95 | 100 | 100 | 100 | 100 | 75 | 100 |

TABLE 6

| ADDITIVE | (CRYSTAL SIZE) FUEL I | II | III | IV | V | VI | VII | VIII |
|---|---|---|---|---|---|---|---|---|
| $A^1$ | 5 | 5* | 7 | 8 | 5 | 6* | 5 | 3 |
| $A^1B^1$ | 6 | 9 | 9 | 9 | 6 | 9 | 6 | 6 |
| $A^1B^1D^1$ | 6 | 9 | 10 | 10 | 7 | 10 | 9 | 8 |
| $A^1B^1E^1$ | 6 | 9 | 10 | 10 | 6 | 10 | 7 | 8 |
| $A^1B^1F^1$ | 5 | 9 | 10 | 10 | 5 | 10 | 5 | 6 |

*ALSO CONTAINED SMALL CRYSTALS

Lastly, cloud points of certain of the above fuels alone and when containing certain of the above-described additives were measured as described herein. Results obtained were as follows (in °C.):

TABLE 7

| ADDITIVE | (CLOUD POINT) FUEL II | IV | VI | VII |
|---|---|---|---|---|
| None | −7 | −8 | −5 | −1 |
| $A^1$ | −7 | −6 | −5 | −1 |
| $A^1B^1$ | −8 | −8 | −8 | −2 |
| $A^1B^1D^1$ | −8 | −10 | −10 | −4 |
| $A^1B^1E^1$ | −8 | −9 | −9 | −2 |
| $A^1B^1F^1$ | −8 | −9 | −9 | −2 |

The results show that the additive compositions of the invention may give rise to cloud point depression.

We claim:

1. Middle distillate fuel oil containing from 0.0001 to 5.0 wt. % of a polymer of molecular weight 1,000 to 10,000 containing the repeating units:

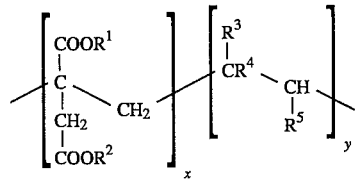

(I) (II)

or

-continued

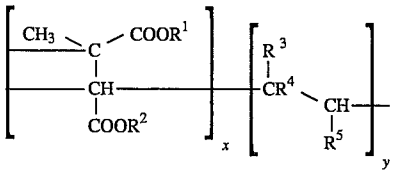

(III) (II)

where x is an integer and y is 0 or an integer and wherein in the total polymer x+y is at least two and the ratio of units (II) to units (I) is between 0 and 2, the ratio of units (II) to (III) is between 0 and 2, and wherein:

$R^1$ and $R^2$ are the same or different and are $C_{10}$ to $C_{30}$ alkyl, $R^3$ is H, —OOC $R^6$, $C_1$ to $C_{30}$ alkyl, —COO, $R^6$, an aryl or aralkyl group or halogen, $R^4$ is H or methyl, $R^5$ is H, $C_1$ to $C_{30}$ alkyl or —$COOR^6$, $R^6$ is $C_1$ to $C_{22}$ alkyl, and provided each of the groups $R^1$, $R^2$, $R^3$, $R^4$, $R^5$ and $R^6$ can be inertly substituted, and containing another low temperature flow improver which is a comb polymer of the formula:

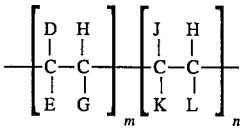

where

D=R, C(O).OR, OC(O).R,$R^1$C(O).OR or OR,

E—H or $CH_3$ or D or $R^1$,

G=H, or D, m=1.0 (homopolymer) to 0.4 (mole ratio),

J=H, $R^1$, aryl or heterocyclic group, $R^1$CO.OR,

K=H, C(O).$OR^1$, OC(O).$R^1$, $OR^1$, C(O)OH,

L=H, $R^1$, C(O),.$OR^1$, OC(O).$R^1$, $OR^1$, aryl C(O)OH, n=0.0 to 0.6 (mole ratio), R is a hydrocarbyl group containing from 10 to 30 carbon atoms, and $R^1$ is a $C_1$ to $C_{30}$ hydrocarbyl group.

2. The composition of claim 1 in which the polymer is a homopolymer of a dialkyl itaconate or citraconate or a copolymer of a dialkyl itaconate or citraconate with an aliphatic olefin, a vinyl ether, a vinyl ester of an alkanoic acid, an alkyl ester of an unsaturated acid, an aromatic olefin, a vinyl halide or a dialkyl fumarate or maleate.

3. The composition according to claim 1 in which the polymer is a copolymer of dialkyl itaconates or dialkyl citraconates with an aliphatic olefin, a vinyl ester or an alkyl substituted vinyl ester of $C_2$ to $C_{31}$ alkanoic acid.

4. The composition of claim 3 in which the molecular weight of the polymer is between 2,200 and 5,000.

5. Middle distillate fuel oil containing from 0.0001 to 5.0 wt. % of a polymer of molecular weight 1,000 to 10,000 containing the repeating units:

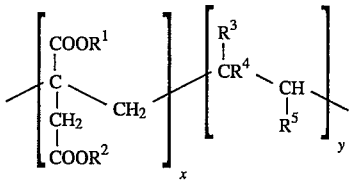

(I) (II)

or

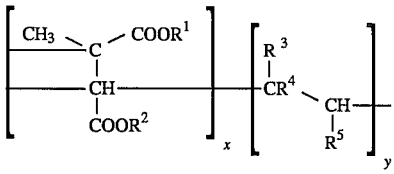

(III) (II)

where x is an integer and y is 0 or an integer and wherein in the total polymer x+y is at least two and the ratio of units (II) to units (I) is between 0 and 2, the ratio of units (II) to (III) is between 0 and 2, and wherein:

$^1$ and $R^2$ are the same or different and are $C_{10}$ to $C_{30}$ alkyl, $R^3$ is H, —OOC $R^6$, $C_1$ to $C_{30}$ alkyl, —COO, $R^6$ is an aryl or aralkyl group or halogen, $R^4$ is H or methyl, $R^5$ is H, $C_1$ to $C_{30}$ alkyl or —$COOR^6$, $R^6$ is $C_1$ to $C_{22}$ alkyl and provided each of the groups $R^1$, $R^2$, $R^3$, $R^4$, $R^5$ and $R^6$ can be inertly substituted, and the fuel oil containing another low temperature flow improver selected from the group consisting of (a) an ethylene unsaturated ester copolymer or (b) an amine salt and/or an amide formed by reacting a hydrocarbyl substituted amine with a hydrocarbyl acid having 1 to 4 carboxylic acid groups or corresponding anhydride groups.

6. The composition of claim 5 where said other low temperature flow improver is an ethylene vinyl acetate copolymer.

* * * * *

UNITED STATES PATENT AND TRADEMARK OFFICE

CERTIFICATE OF CORRECTION

PATENT NO. : 5,478,368
DATED : December 26, 1995
INVENTOR(S) : K. Lewtas and J.D. Bland It is certified that error appears in the above-indentified patent and that said Letters Patent is hereby corrected as shown below:

Column 28, line 38

"$^{1}$" should be –$R^{1}$–.

Signed and Sealed this

Second Day of July, 1996

Bruce Lehman

*Attest:*

BRUCE LEHMAN

*Attesting Officer*

*Commissioner of Patents and Trademarks*